United States Patent [19]

Riopelle

[11] 4,071,382

[45] Jan. 31, 1978

[54] METHOD FOR CASE HARDENING POWDERED METAL PARTS

[75] Inventor: Joseph A. Riopelle, Toledo, Ohio

[73] Assignee: Midland-Ross Corporation, Cleveland, Ohio

[21] Appl. No.: 707,843

[22] Filed: July 22, 1976

[51] Int. Cl.[2] ..... B22F 3/00

[52] U.S. Cl. ..... 148/126; 148/16.6

[58] Field of Search ..... 148/16.6, 31.5, 126

[56] References Cited

U.S. PATENT DOCUMENTS

| | | | |
|---|---|---|---|
| 3,276,919 | 10/1966 | Todd | 148/126 |
| 3,615,380 | 10/1971 | Fichte | 148/126 |
| 3,743,551 | 7/1973 | Sanderson | 148/16.6 |
| 3,880,600 | 4/1975 | Zboril | 148/16.6 |
| 3,892,597 | 7/1975 | Lincoln et al. | 148/16.6 |
| 3,904,448 | 9/1975 | Takahashi et al. | 148/126 |

*Primary Examiner*—Brooks H. Hunt
*Attorney, Agent, or Firm*—Frank J. Nawalanic

[57] ABSTRACT

A method and apparatus is provided for case hardening a porous, powdered metal part by means of a gaseous atmosphere without incurring excessive embrittlement or unacceptable physical distortion of the part. Prior to subjecting the part to the case hardening gaseous atmosphere, the part is heated in an oxidizing atmosphere for a time period sufficent to form oxides of iron which substantially fill the pores at the surface of the part. When the part is later subject to the case hardening gaseous atmosphere, at least one element of the gaseous atmosphere reacts with the oxides of iron and Fe to produce hardenable iron compounds.

4 Claims, 10 Drawing Figures

METHOD FOR CASE HARDENING POWDERED METAL PARTS

This invention relates generally to method and apparatus for case hardening porous, powdered metal parts and more particularly to a method and apparatus for case hardening powdered metal parts by means of a gaseous atmosphere.

The invention is particularly applicable to case hardening steel powdered metal parts by a conventional process known in the art as nitriding and will be described with particular reference thereto. However, it will be appreciated by those skilled in the art that the invention may apply to all types of case hardening processes which can be accomplished by means of a gaseous atmosphere, such as carburizing, carbonitriding, etc.

A powdered metal part is defined herein to mean a metal powder(s) compacted under pressure in a mold to produce an item of preconfigured shape which is then sintered to produce a desirable metallurgical bond. All such metal powdered parts are characterized by a porous structure, with interconnecting porosity or pores extending throughout the part.

It is known that steel powdered metal parts do not readily lend themselves to case hardening by means of gaseous atmosphere. For example, it is known that if a powdered steel metal part was subjected to an ammonia atmosphere in an attempt to produce a nitrided surface, the treated part would be extremely brittle and the dimensions of the part would be adversely affected by such process with the degree of brittleness and tolerance control dependent upon the amount of porosity. This brittleness and dimensional distortion is believed to result from iron nitrides formed throughout the powdered metal part as the ammonia gas penetrates the pores of the part.

The prior art has at least tacitly recognized the problem to exist as stated above. Conventional attempts at case hardening powdered metal parts by means of a gaseous atmosphere call for the part to be subjected to a second sintering step under pressure before case hardening. The second sintering step obviously increases the density of the part which impedes the penetration of the gaseous atmosphere through the part so that case hardening to some extent can occur. However, it is obviously more costly to conduct the second process sintering step and it is extremely difficult to hold finished part dimensions to specified close tolerances. Within the published literature, an article entitled "Heat Treatment of Piece/and Parts" appearing in the June, 1975 issue of Metal Progress suggests filling the pores of the powdered metal part with copper before subjecting the part to a case hardening heat treatment. However, it is believed that there are limits associated with such a process when copper is employed to fill the pores of a powdered metal part which, among other things, requires the part to be cleansed of the copper on the surface prior to case hardening. The only other commercially practiced process for case hardening powdered metal parts known at the present time has been the use of a salt bath wherein powdered metal parts have apparently been satisfactorily nitrided in a commercial sense at least with respect to the case hardness of the part. However, this process is limited to nitriding at low temperatures. Also, on a general level, all salt baths are inherently afflicted with problems concerning contamination and, because a cyanide or cyanate salt is employed, the method is inherently inconvenient and hazardous from a processing point of view. Such hazards and process restrictions are substantially eliminated when a gaseous case hardening atmosphere is used.

With respect to the teachings of the prior art concerning conventional case hardening processes for "solid" steel parts, it is generally widely known that oxidation of the part prior to the case hardening is to be avoided. For example, it is conventionally known that if a portion of a part is not to be nitrided, it is treated with any one of a number of proprietary oxide paints, generally containing tin oxide and another vehicle, which paint is reduced in a nitriding atmosphere to metallic tin to effectively prevent case hardening in the selected painted area of the part. Some investigators recognize that the presence of an oxide film will inevitably occur on the part to be case hardened and have purposely developed a "passive" oxide film on the part which will not inhibit the case hardening process. An example of such an approach may be found in U.S. Pat. No. 3,885,995. With respect to salt bath processes, it is generally known to preheat the part before submersion within the bath to avoid salt solidification which would otherwise occur if the part were immersed in a cold state in the bath. Generally, the part is preheated in an inert atmosphere. However, in the nitride salt bath process referred to above, preheat occurs in an air atmosphere and oxidation will necessarily occur to some extent which is not viewed as being detrimental to the salt bath process. This preheat step is essentially viewed as a temperature requirement and is employed whether the treated part be a solid part or a powdered metal part.

It is thus an object of the present invention to provide method and apparatus for case hardening a steel powdered metal part by means of a gaseous atmosphere.

Yet another object of the subject invention is to provide a method and apparatus for preconditioning a steel powdered metal part which will permit the part to be subsequently case hardened by means of conventional techniques employing gaseous atmospheres.

It is a more specific object of the subject invention to effect gas carburizing or gas nitriding or gas carbonitriding a steel powdered metal part by oxidizing the powdered metal part before subjecting same to a gaseous atmosphere associated with any of the afore-mentioned processes.

Yet a more specific object of the invention is to effect case hardening of a steel powdered metal part by means of a gaseous atmosphere which results in a minimal dimensional distortion and/or minimal dimensional growth of the part.

The objects noted above are achieved by a process and apparatus wherein a porous steel powdered metal part is placed in a chamber and preheated in an oxidizing atmosphere at a predetermined temperature, nominally 800°–1000° F., and for a predetermined time, normally one-half to one hour, during which oxides of iron substantially fill the interconnecting porosity of the part at the surface of the part. The part is then placed in a closed chamber and subjected to any one of a number of different gaseous atmosphers dependent upon the type of case hardening desired and at predetermined temperature and times so that the oxides of iron formed in the preheat step and the existing iron within the part react with the gaseous atmosphere to produce hardenable iron compounds. Importantly, the oxidation and case hardening steps are controlled to minimize distortion and growth of the part.

The invention may take physical form and be specifically described in certain parts, certain steps, arrangement of parts and arrangement of steps, a preferred embodiment of which will be described in detail and illustrated in the accompanying drawing and photographs which form a part hereof and wherein.

Figure 1:
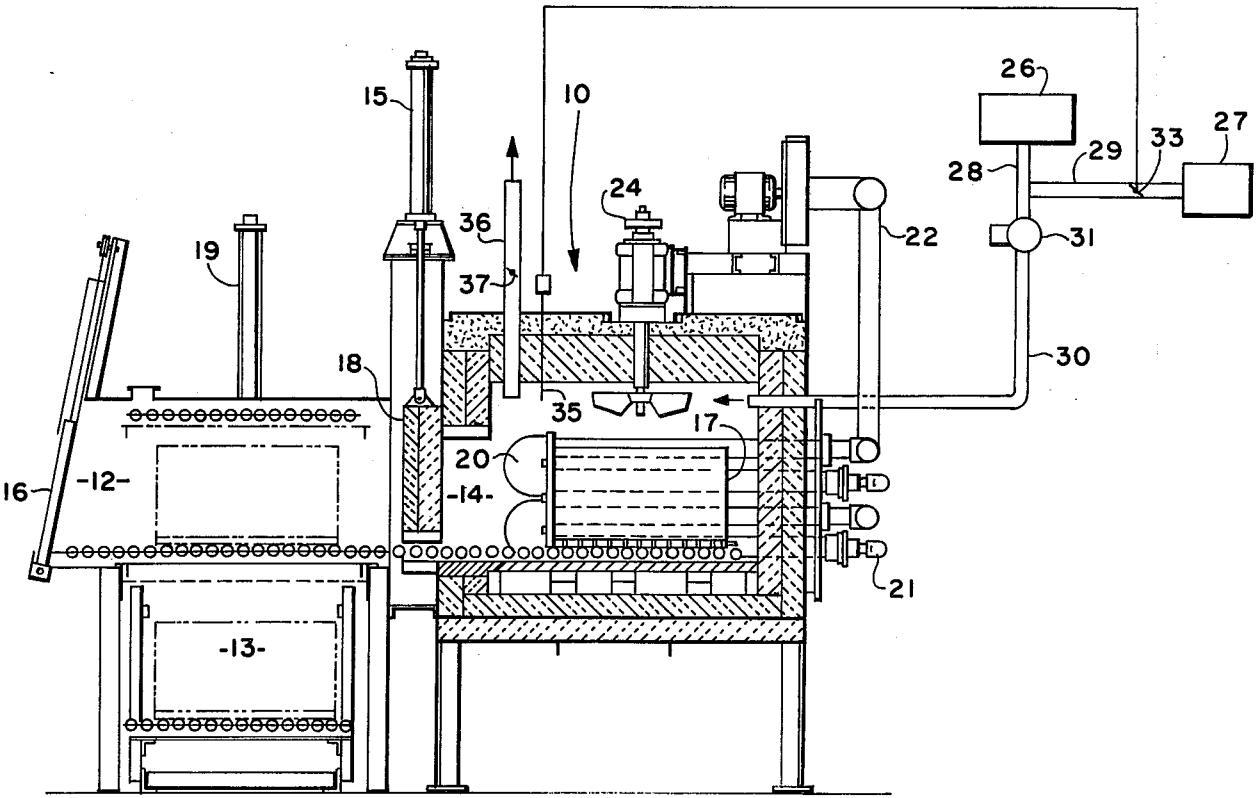
FIG. 1 is a longitudinally sectioned, schematic view of a typical furnace application employed in the case hardening of powdered metal parts in accordance with the invention.

Referring now to the drawings wherein the showing are for the purpose of illustrating a preferred embodiment of the invention only and not for the purpose of limiting same, there is shown in FIG. 1 a conventional, radiantly heated furnace 10 commonly employed in the case hardening of metal parts. Furnace 10 includes a vestibule chamber 12, a quench tank chamber 13 located beneath vestibule chamber 12 and a heating chamber 14 located on one side of vestibule chamber 12. A sealable outer charging door 16 is provided in vestibule chamber 12 for entry and exit of a charge basket 17 containing the powdered metal parts. A refractory inner door 18 between vestibule chamber 12 and heating chamber 14 provides ingress and egress of charge basket 17 between the vestibule and heating chambers 12, 14. A hydraulic cylinder 15 is provided for opening and closing inner door 18 and a similar type of a cylinder (not shown) is provided for opening and closing charging door 16. A hydraulic cylinder 19 is likewise provided for lowering and raising charge basket 17 into or out of quench tank 13 which may be either an oil or a water quench.

Provided within heating chamber 14 is a plurality of closed U-shaped tubes 20. Within one end of each U-shaped tube 20 is a burner 21 firing heated combustibles lengthwise through U-shaped tubes 20 with the combustibles being exhausted from the tubes by means of an exhaust duct-fan arrangement 22 connected to the opposite ends of U-shaped tubes 20. Also extending within the furnace is a circulating fan 24 for circulating the atmosphere in the heating chamber through the parts contained in charge basket 17. Means are also provided within heating chamber 14 for providing a gaseous case hardening atmosphere in a controlled manner into heating chamber 14. The gaseous atmosphere means includes a first source 26 of the gaseous atmosphere containing certain elements of the gaseous atmosphere depending upon the particular case hardening desired and a second source 27 of the gaseous atmosphere. Both elements are introduced into heating chamber 14 by means of a tube 30 and a blower or a fan 31 in tube 30.* In a line 28 leading from first source 26 to tube 30 or in a line 29 leading from second source 27 to tube 30 is a regulator schematically shown as 33. The operation of regulator 33 is controlled by electrical impulses generated from a probe 35 extending into heating chamber 14 which controls the ratio of second source 27 (or first source 26) of the gaseous atmosphere to thus control the make-up of the gaseous atmosphere entering heating chamber 14 through tube 30. An exhaust tube 36 is provided for egress of the atmosphere out of heating chamber 14 and an adjustable baffle plate 37 controls the pressure of the gaseous atmosphere within heating chamber 14.

* Alternately and preferably, fan 31 could be eliminated and pressure in Tube 30 could result from either the gas generator or natural gas line pressure.

The operation of the heat treat furnace shown in FIG. 1 will be explained with reference to a nitriding, case hardening process which was employed for all the powdered metal parts shown in FIGS. 2, 3 and 4. The powdered metal parts which were nitrided all had chemical compositions comprising carbon — 1.24%, manganese — 0.20%, silicon — 0.04%, phosphorous — 0.019% and sulfur — 0.018%. The porosity of the parts in an "as sintered" condition was estimated as being 20% porosity on the surface and being gradually reduced through the cross section of the part until reaching 10% porosity at the core. It is noted that the normal density of a typical carbon steel material is 7.863 grams/c.c. and that the density of powdered metal parts is typically between 6.6 and 7.2 grams/c.c. The process described herein is believed to produce commercially acceptable case hardened surfaces with powdered metal parts having density ranges as low as 6.6. The nitriding of the powdered metal parts was accomplished by subjecting the parts first to a carrier gas of approximately 95–97% $N_2$, ½ to 1% CO and 2–4% $H_2$. To this carrier gas $NH_4$ was added so that the resultant nitriding atmosphere had a content of 5–25% $NH_3$. The hydrogen limit of the nitriding gas was then controlled so that $H_2$ did not exceed 15% of the nitriding atmosphere. Reference may be had to U.S. Pat. No. 3,892,597 which is incorporated herein by reference for a detailed description of the method, including temperatures, times, and nitriding atmosphere controls which were employed in nitriding the parts.

A charge basket 17 filled with powdered metal parts is conveyed into heating chamber 14. With charging door 16 and inner door 18 open, burners 21 are fired into U-shaped tubes 20 and fan 24 is operated to provide circulation of air atmosphere. The parts were heated in such oxidizing atmosphere to a temperature of approximately 800°–1100° F. for a time period between one-half to one hour. Charge basket 17 is then moved into vestibule 12 and allowed to cool to room temperature by means of air cooling. Charge basket 17 with the parts which are now oxidized is then placed back into heating chamber 14 with inner door 18 sealed and the parts nitrided by means of the nitriding gaseous atmosphere noted above in accordance with the procedure set forth in U.S. Pat. No. 3,892,597. Following the nitriding step, the parts are allowed to be either atmosphere cooled or oil quenched, although they could by air cooled or water quenched. Specifically, the parts could be subjected to the case hardening after oxidation heating without reduction in their temperature. It is also to be noted that the furnace illustrated in FIG. 1 is a typical, standard furnace in which the case hardening process described can be worked. It is contemplated that for a continuous line operation, a second vestibule chamber and quench tank would be incorporated at the opposite side of heating chamber 14 by a second inner door 18. Furthermore, vestibule chamber 12 could be provided with its own heating elements for oxidation heating. In this manner, the oxidation step could occur in the vestibule chamber while case hardening was occurring in heating chamber 14. When the case hardening treatment was completed, charge basket 17 containing the oxidized parts in vestibule chamber 12 could be moved into heating chamber 14 while the case hardened part could be moved into the second vestibule whereat same could be cooled or quenched in any known desired manner to achieve desired physical properties.

Reference will now be made to the photographs (FIGS. 2 and 4) showing etched samples of powdered metal parts wherein (a) the white areas in the grain boundaries will be designated as 50 and defined as iron nitrides (believed to be substantially $Fe_4N$), (b) black areas between grain boundaries will be designated as 51 and will be defined as voids or pores in the powdered part, (c) gray areas between grain boundaries will be designated as 52 and defined as iron oxide (believed to be substantially FeO and $Fe_3O_4$), (d) "peppery" structure in the grain boundaries will be designated as 54 and defined as iron nitrides (believed to be substantially $Fe_4N$) formed from iron oxide and (e) lamellar structure which is pearlite and designated as 55. With respect to the photographs of the unetched powdered metal parts (FIG. 3), (i) black areas, designated as 51, are defined as voids, (ii) gray areas, designated as 52, are defined as iron oxides, (iii) "peppery" structure, designated as 53, are iron nitrides and (iv) white area, designated as 56, is the base material of the part, pearlite and ferrite.

Figure 3A:
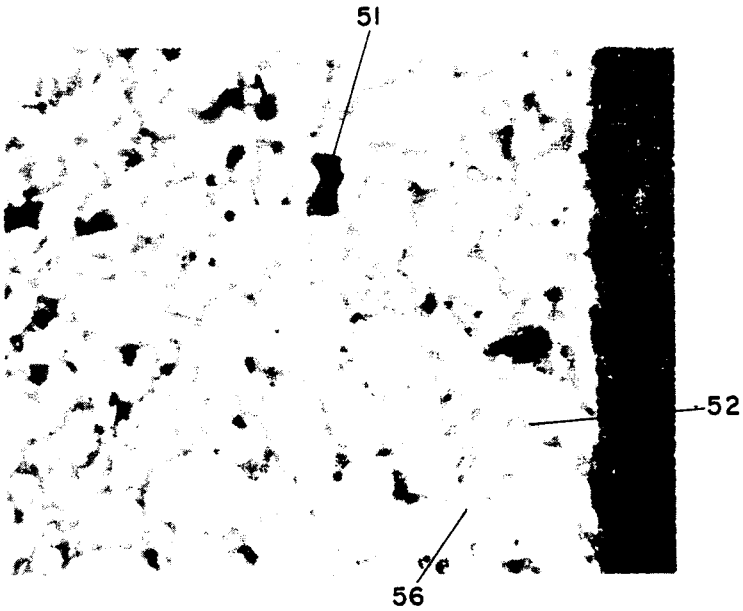
FIGS. 3A and 3B are photographs of 200 × magnification of an unetched sample of a powdered metal part.

FIG. 3A is a photograph of 200 magnification of an unetched powdered metal part sample referred to above which was oxidized for one hour at 1100° F. The surface of the part is at the right of the photograph. It is noted that the interconnecting porosity of the part near its surface has been substantially filled with gray areas of iron oxide 52 and that the larger voids or pores 51 closest to the surface of the part have been reduced in size. FIG. 3A should be contrasted to the photograph shown in FIG. 2A which is a 500 magnification (nital) etch sample of the oxidized part taken at the core of the sample. Photograph 2A shows a small amount of oxidation occuring at the smallest voids or pores 51. The oxygen is believed to permeate through the interconnecting porosity of the powdered metal part forming metal oxides in the process. The metal oxide forms a scale at the smallest pores or voids which inhibits further permeation of the oxygen. This causes the oxygen to remain in contact with larger voids or pores upstream of the smaller voids resulting in further formation of metal oxide which reduces and eventually fills or plugs successively larger pores or voids. The same type of action is believed to occur when a sponge is used to soak up water in that the sponge will first absorb the water at its outer surface until its outer surface is saturated, the water then being saturated into the core. Importantly, the oxidation in the present invention is continued until the iron oxide substantially fills the interconnecting porosity at and slightly below the surface of the powdered metal part. The iron oxide formed is believed to comprise primarily wustite, FeO, and magnotite $Fe_3O_4$, although it may be possible that hematite, $Fe_2O_3$, may also exist.

Figure 2A:
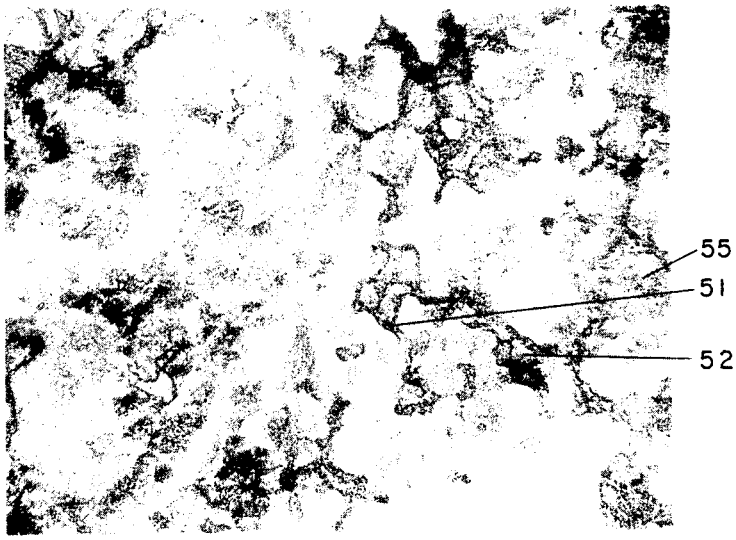
FIGS. 2A, 2B, 2C and 2D are photographs of 500 × magnification of an etched sample of a powdered metal part.
Figure 2B:
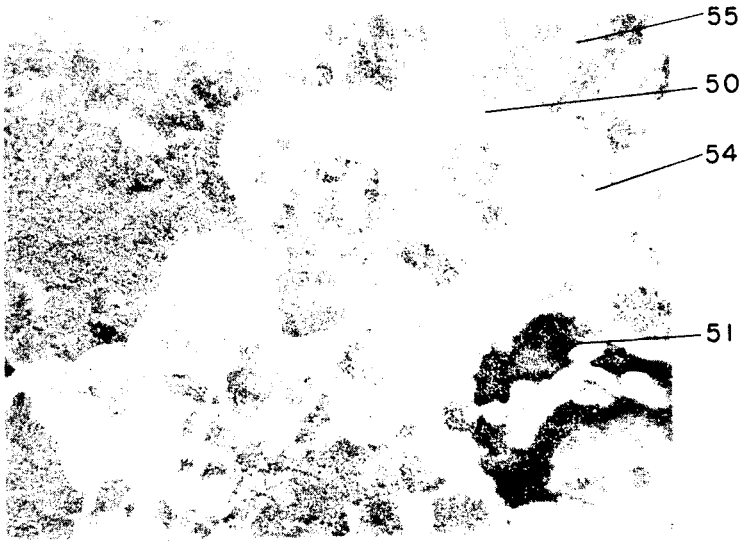
Figure 2C:
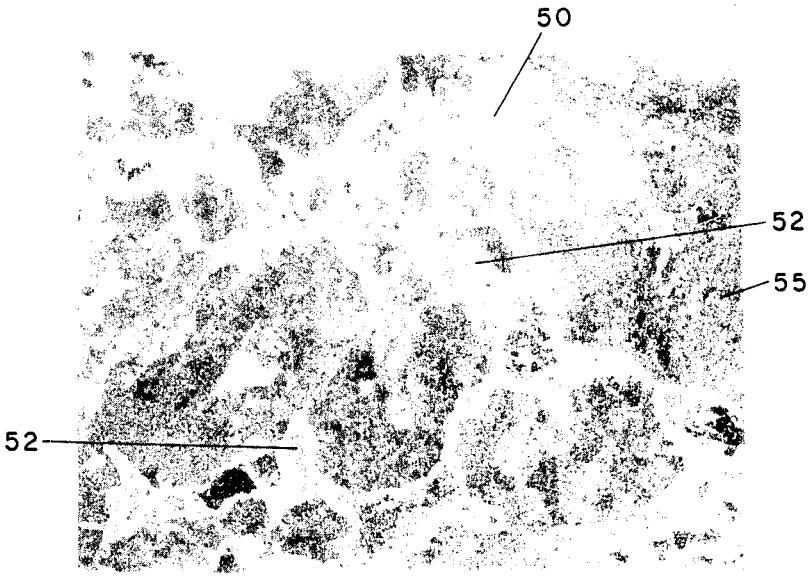
Figure 2D:
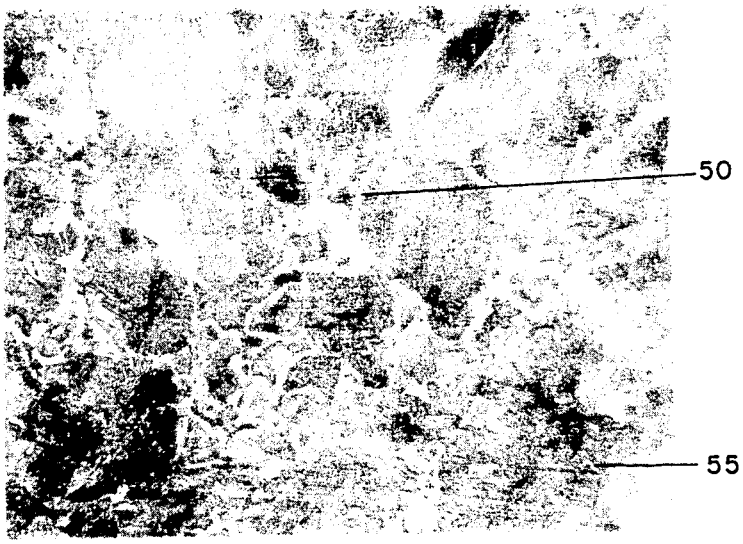
Figure 3B:
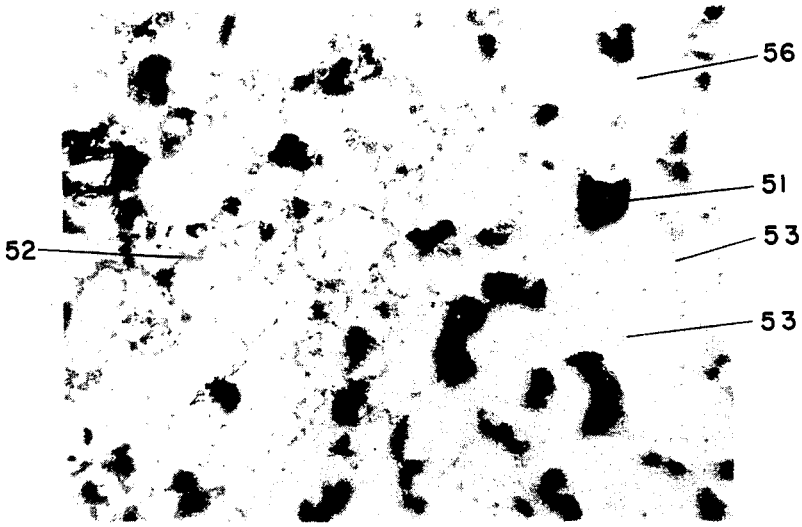

FIGS. 3B, 2B and 2C are photographs taken of samples which have been nitrided in accordance with the procedure set forth in U.S. Pat. No. 3,892,597 after the powdered metal part has been oxidized for one hour by heating in air at 1100° F. Photograph 3B is a 200 magnification of an unetched sample with the surface of the part being at the right-hand side of the photograph as shown. It is noted that the gray areas of iron oxide 52 near the surface of the part have been substantially converted to iron nitride 54 with the oxides spaced farther from the surface being only partially converted to iron nitride. This fact may be better illustrated by viewing photographs shown in FIGS. 2B and 2C which are 500 magnifications of nital etched samples. The photograph shown in FIG. 2B is taken at the surface of the part and the photograph shown in FIG. 2C is taken slightly below the surface of the part. In FIG. 2B, the white areas 50 are iron nitrides formed from the base material. The peppery structure 54 between the grain boundaries are iron nitrides formed from the iron oxides previously present at the surface of the part. The substantial absence of gray areas representing iron oxide in FIG. 2B should be noted. FIG. 2B should be contrasted with the photograph identified as FIG. 2C. The gray areas 52 representing iron oxide are still present in some form in the voids or pores of the part shown in FIG. 2C and the gradual change from the gray oxide areas 52 to the white nitride areas 50 in the grain boundaries should be observed. FIGS. 3B, 2B and 2C definitely show that the iron oxides effectively act to plug the interconnecting porosity and prevent the formation of iron nitrides throughout the part which heretofore had occurred when a powdered metal part was nitrided in its as sintered form. For example, the photograph shown in FIG. 2D is a nital etch of 500 magnification taken at the core of a powdered metal part which had not been oxidized but was nitrided under the same circumstances as that for the samples shown in FIGS. 3B, 2B and 2C. Note the formation of white areas of iron nitride 50 occurring at the core of the metal part.

Figure 4A:
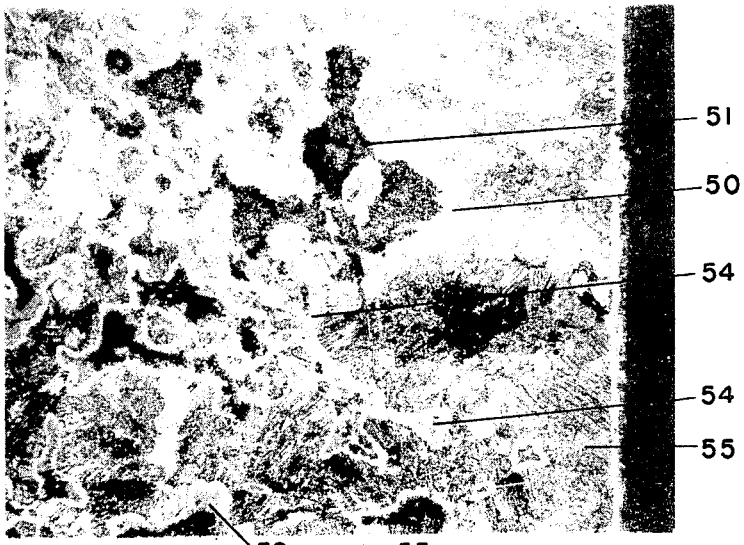
FIGS. 4A, 4B and 4C are photographs of 500 × magnification of an etched sample of a powdered metal compact subjected to a nitriding atmosphere for various time periods.
Figure 4B:
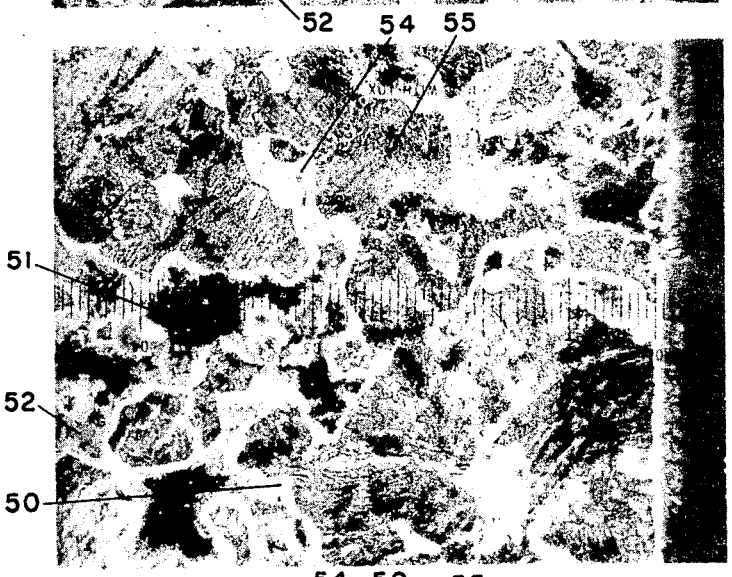
Figure 4C:
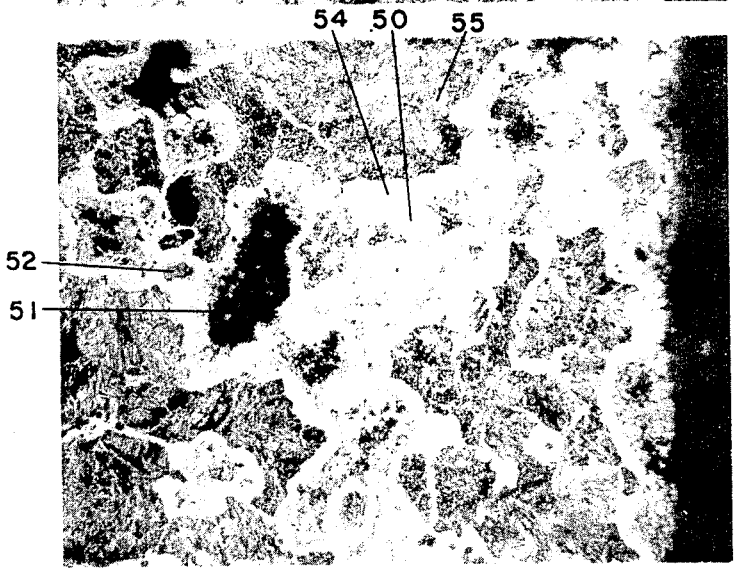

FIGS. 4A, 4B and 4C show the effect of the length of time of the nitriding cycle. All photographs are nital etches of 500 magnification with FIG. 4A showing a nitriding cycle of 30 minutes duration, FIG. 4B showing a nitriding cycle of 60 minutes duration and FIG. 4C showing a nitriding cycle of 90 minutes duration. The surface of the part is shown at the right-hand side for all the photographs. There is a definite progression for converting the gray iron oxide areas 52 into the peppery iron nitride areas 54 as the nitriding time increases. Furthermore, the depth of the nitriding case as evidenced by the white areas of iron nitride 50 and the peppery areas of iron nitride 54 increases as the nitriding cycle increases. These results compare favorably with what one skilled in the art would expect to occur in the nitriding of a "solid" steel part. However, it should be noted that the gas nitriding cycle is extremely short when contrasted to other known nitriding cycles.

As noted above, it is an important feature of the subject invention that case hardening can occur according to the process and apparatus disclosed herein with a minimum amount of dimensional distortion of the metal part. Tests conducted on plain carbon (0.5% carbon) sintered steel rings of 7 inch diameter with thickness of ½ inch and a height of 1 inch which were oxidized at 1050° F. for approximately 1 hour followed by a nitriding cycle of approximately 60 minutes, showed dimensional variation of 0.004 to 0.003 inches and an average increase in diameter of the part of 0.0031 inches. It was noted that 0.0005 inches increase in diameter occurred following the oxidation step. From an analysis of the etched samples when compared to the growth of the part, the oxidation cycle should be between 800°-1100°

F. at times cycles between 30 minutes and 120 minutes to provide sufficient "filling" or "plugging" of the porosity or voids with minimum distortion of the part.

Once the oxidation step has been optimized in this manner, further tests have shown that dimension distortion will occur as a function of the length of the nitriding time cycle. This is shown below in tabular form for a powdered metal part of the composition noted above nitrided for 30, 60 and 90 minute cycles. The parts were oxidized at a temperature of approximately 1050° F. for a time period of approximately 1 hour prior to nitriding. Nitriding gas comprised essentially 25% ammonia and part configuration was basically that of a hollow cylinder, approximately, having a bore of ¾ inches diameter, a height of 2 inches and an outside diameter of 4 inches.

| Nitriding Cycle | Mean Bore Growth | Mean Width Growth |
|---|---|---|
| 30 minutes | 0.000917 | 0.00127 |
| 60 minutes | 0.00157 | 0.00168 |
| 90 minutes | 0.00160 | 0.00275 |

As expected from analysis of the data above, the longer the nitriding cycle, the greater the distortion becomes. Importantly, it has been determined that significant wear improvements result when contrasted to an "as sintered" metal part with a nitriding cycle as short as 30 minutes. A nitriding cycle as long as 90 minutes would produce the hardest case desirable, considering ductility, in a commercial application. Increase in nitriding time above 90 minutes is believed to result in a brittle case and dimensional distortion beyond commercially acceptable tolerance limits.

While the invention has been described with reference to a specific case hardening process known as nitriding, other known case hardening processes may be employed. Specifically, carburizing of powdered metal parts can readily occur after filling the voids or porosity of the powdered metal part with iron oxides as described above. This can be accomplished by subjecting the oxidized powdered metal part to a reducing carrier gas atmosphere comprising, for example, 40% — $H_2$, 40% — $N_2$ and 20% — CO. This atmosphere would then be supplemented with a carbon containing gas such as methane, $CH_4$, in predetermined amounts. The reducing gas will reduce the iron oxides to pure metallic iron (Fe) which at elevated temperatures will undergo the usual interstitial solid solution carbon phase where the iron changes from a body centered cubic to a face centered cubic lattice. The carrier gas, as with the nitriding process, is viewed primarily as a neutral gas even though some absorption of carbon from CO will occur. The addition of methane (as with the addition of ammonia in the nitriding process) is viewed as the gas primarily responsible for effecting carburization of the part. Since the oxidation can thus effectively function for case hardening of powdered metal parts by carburizing and nitriding, it would be expected to function in case hardening processes employing characteristics of both carburizing and nitriding such as in carbonitriding.

It is also expected that the presence of alloy elements in the powdered metal parts will not seriously detract from the process described since at the temperatures disclosed the formation of iron oxide is believed to occur more readily than the oxidation of conventional alloy in elements The invention has been described with reference to a preferred embodiment. Obviously, modifications ad alterations will occur to others upon the reading and understanding of the specification. It is my intention to include all such modifications and alterations insofar as they come within the scope of the present invention.

It is thus an essential feature of the invention to provide method and apparatus for case hardening powdered metal parts by oxidizing the part prior to hardening same in a gaseous atmosphere so that the porosity of the part is substantially filled with iron oxide at the part's surface thereby impeding the flow of the case hardening gas through the part during hardening while the case hardening gas reduces the iron oxides to a hardenable case compound.

Having thus defined the invention, I claim:

1. A process for case hardening a powdered metal part having a porous, sintered body of a heat treatable steel composition comprised primarily of Fe, said process comprising the steps of:

heating said part in an oxidizing atmosphere for a time period sufficient to form oxides of iron substantially filling the pores of said part at the surface of said part; and subjecting said part to a predetermined gaseous atmosphere at a predetermined temperature and time sufficient to react with said oxides of iron and said Fe to produce hardenable iron compounds.

2. The process of claim 1 wherein said parts are initially subjected after oxidation to a neutral carrier gas atmosphere to which is added a gas principally responsible for hardening the case of said part.

3. The process of claim 1 wherein said heating step occurs at a temperature range of 800° to 1100° F. for a period of time from 30 minutes to 120 minutes.

4. The process of claim 3 wherein said atmosphere includes ammonia and said case is formed of iron nitride.

* * * * *